United States Patent [19]

Clark et al.

[11] Patent Number: 4,612,424

[45] Date of Patent: Sep. 16, 1986

[54] DOOR MOUNTED CIRCUIT BREAKER OPERATING APPARATUS

[75] Inventors: Michael R. Clark; Dominick Tringali, both of Columbia; Fredrick E. Woodlief, Lexington; Miklos J. Orosz, Columbia, all of S.C.

[73] Assignee: Square D Company, Palatine, Ill.

[21] Appl. No.: 666,945

[22] Filed: Oct. 31, 1984

[51] Int. Cl.[4] ..... H01H 9/20

[52] U.S. Cl. ..... 200/50 A; 361/344; 200/330

[58] Field of Search ..... 361/344; 200/330, 50 R, 200/50 A, 61.85, 336, 337

[56] References Cited

U.S. PATENT DOCUMENTS

| | | | |
|---|---|---|---|
| 2,698,361 | 12/1954 | Mekelburg | 200/50 |
| 2,806,099 | 9/1957 | Rexroad | 200/50 |
| 2,882,359 | 4/1959 | Edmunds et al. | 200/50 |
| 3,009,029 | 11/1961 | Bodenschatz et al. | 200/50 A |
| 3,086,092 | 4/1963 | Poulton, Jr. | 200/50 |
| 3,226,500 | 12/1965 | Kussy et al. | 200/50 |
| 3,335,238 | 8/1967 | Zavertnik et al. | 200/50 |
| 3,382,331 | 5/1968 | Jencks | 200/50 A |
| 3,657,497 | 4/1972 | Homberg et al. | 200/50 A |

*Primary Examiner*—G. P. Tolin

*Attorney, Agent, or Firm*—A. Sidney Johnston; Richard T. Guttman

[57] ABSTRACT

The invention has an enclosure, a circuit breaker mounted inside the enclosure, and a hand lever rotatably mounted upon a door of the enclosure. A drive shaft is rotatably attached at a first end to the circuit breaker so that rotation of the drive shaft operates the circuit breaker. When the door is closed a second end of the drive shaft seats in a socket in the hand lever, and rotation of the hand lever rotates the drive shaft. A spring clip is mounted within the hand lever, and the spring clip grips the second end of the drive shaft so that force applied by the hand lever to rotate the drive shaft may deform the spring clip thereby permitting deflection in a coupling between the hand lever and the drive shaft. A retainer plate attached to the hand lever catches the drive shaft when the spring clip is deformed by the force and thereby prevents opening of the door as a safety measure. The drive shaft has a reduced cross-section region between the first end and the second end. An interlock is mounted in a fixed position with respect to the door of the enclosure, and when the door is closed the reduced cross-section region of the drive shaft is located within an opening of the interlock permitting rotation of the drive shaft, and the interlock prevents opening of the door when the drive shaft is in a position corresponding to an "on" condition of the circuit breaker by catching the second end of the drive shaft.

12 Claims, 32 Drawing Figures

DOOR MOUNTED CIRCUIT BREAKER OPERATING APPARATUS

BACKGROUND OF THE INVENTION

1. Field of the Invention

This invention relates to operating handles for electrical switches or circuit breakers mounted within an enclosure, and more particularly to operating handles mounted on the door of the enclosure and providing an interlock to prevent opening of the door when the switch or circuit breaker is turned on.

2. Background of the Invention

Manually operated electric circuit breakers are usually mounted inside an enclosure as a safety measure. Operation of the circuit breaker is accomplished by use of a handle operated from outside of the enclosure when the enclosure is closed. A handle may be simply an extension of a shaft passing through a hole in the enclosure, or the handle may be a more complex mechanical arrangement which is mounted on the exterior of the enclosure and engages a shaft protruding through a hole in the enclosure. An additional function provided by the operating handle is to interlock the door of the enclosure in order to prevent opening of the door while the circuit breaker is turned "on".

Present devices designed to accomplish both operation of the circuit breaker and interlocking of the door use the position of the handle to release the interlock. When the handle is in the position corresponding to the circuit breaker being "off" it is common practice for a pin, or its equivalent, to align with a slot thereby releasing the door. Apparatus having this type of interlock is shown in U.S. Pat. Nos. 3,657,497, 3,335,238, 3,226,500, 2,806,099, and 2,698,361.

A problem with devices of the past is that the mechanical alignment required by the two processes, moving the circuit breaker into the "off" condition and simultaneously aligning a pin for release of the door is not always met at the same lever position. Manufacturing tolerances and alignment of parts within the enclosure lead to a lack of alignment which prevents simultaneously achieving the two processes. For example, the door may release without the circuit breaker toggle being moved far enough to drive the circuit breaker into the "off" condition.

SUMMARY OF THE INVENTION

The invention solves the problem of positive operation of the circuit breaker into the "off" condition before the door of the enclosure is released for opening. The invention has an enclosure, a circuit breaker mounted inside the enclosure, and a hand lever rotatably mounted upon a door of the enclosure. A drive shaft is rotatably attached at a first end to the circuit breaker so that rotation of the drive shaft operates the circuit breaker. When the door is closed a second end of the drive shaft seats in a socket in the hand lever, and rotation of the hand lever rotates the drive shaft.

A spring clip is mounted within the hand lever, and the spring clip grips the second end of the drive shaft so that force applied by the hand lever to rotate the drive shaft may deform the spring clip thereby permitting deflection in a coupling between the hand lever and the drive shaft.

Means are provided for catching the drive shaft by the handle when the spring clip is deformed by the force and thereby preventing opening of the door as a safety measure. The means for catching the drive shaft may be a retainer plate. The drive shaft has a reduced cross-section region between the first end and the second end. An interlock is mounted in a fixed position with respect to the door of the enclosure, and when the door is closed the reduced cross-section region of the drive shaft is located within an opening of the interlock permitting rotation of the drive shaft, and the interlock prevents opening of the door when the drive shaft is in a position corresponding to an "on" condition of the circuit breaker by catching the second end of the drive shaft. Therefore when the door is closed and the circuit breaker is in an "on" condition, then the interlock plate prevents opening of the door. Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
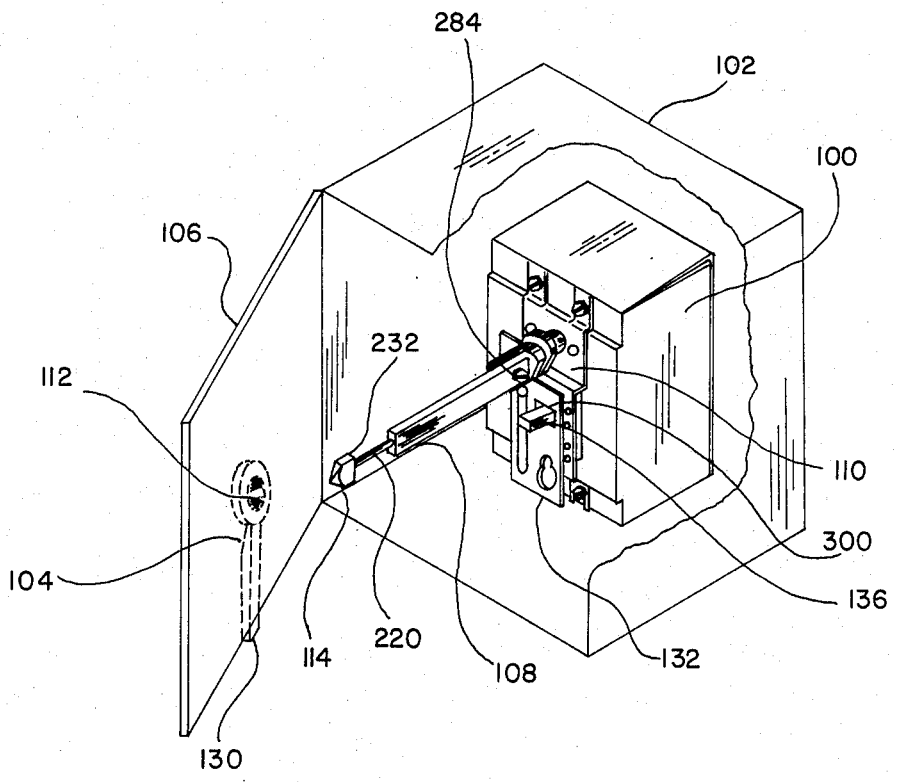
FIG. 1 is an isometric drawing of a circuit breaker operating apparatus mounted on an enclosure containing a circuit breaker.

FIG. 1 shows a circuit breaker 100 mounted within enclosure 102. A handle 104 is mounted upon door 106. Drive shaft 108 is rotatably attached to bracket 110. Handle 104 has a socket 112 which receives head 114 of drive shaft 108, when door 106 is closed.

Figure 2:
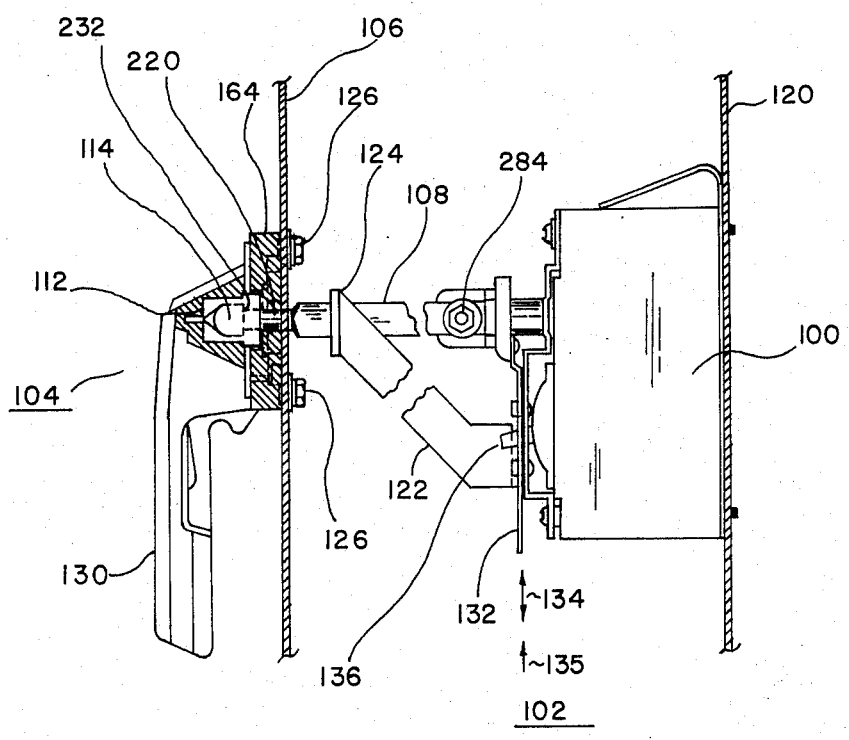
FIG. 2 is a cut away side view of a circuit breaker operating apparatus.

FIG. 2 is a side view showing circuit breaker 100 mounted inside enclosure 102. Back 120 and door 106 of enclosure 102 are also shown. Door 106 is in the closed position. In FIG. 2 handle 104 is shown in cut away, and head 114 of drive shaft 108 is shown in place within socket 112.

Bracket 122 is attached to bracket 110 by screws (not shown), and bracket 122 is not shown in FIG. 1. Bracket 122 is optional, and is found to be useful if drive shaft 108 is sufficiently long that it tends to flex when door 106 is open and drive shaft 108 is unsupported. Bracekt 122 has a hole 124 sufficiently large that drive shaft 108 may freely turn within hole 124. Hole 124 is shown with dots in FIG. 2.

Handle 104 is attached to door 106 by screws 126. It has been found that three screws located at 120 degree separations provide adequate attachment.

In operation, hand lever 130 is rotated by hand action of a person. Drive shaft 108 is rotated by rotation of hand lever 130 because the interior of socket 112 presses against head 114 of drive shaft 108. Slide 132 moves in the directions indicated by double headed arrow 134 as a result of rotation of drive shaft 108. Toggle 136 of circuit breaker 100 is operated by slide 132 as a result of motion of slide 132 in either of the directions indicated by double headed arrow 134.

Figure 3:
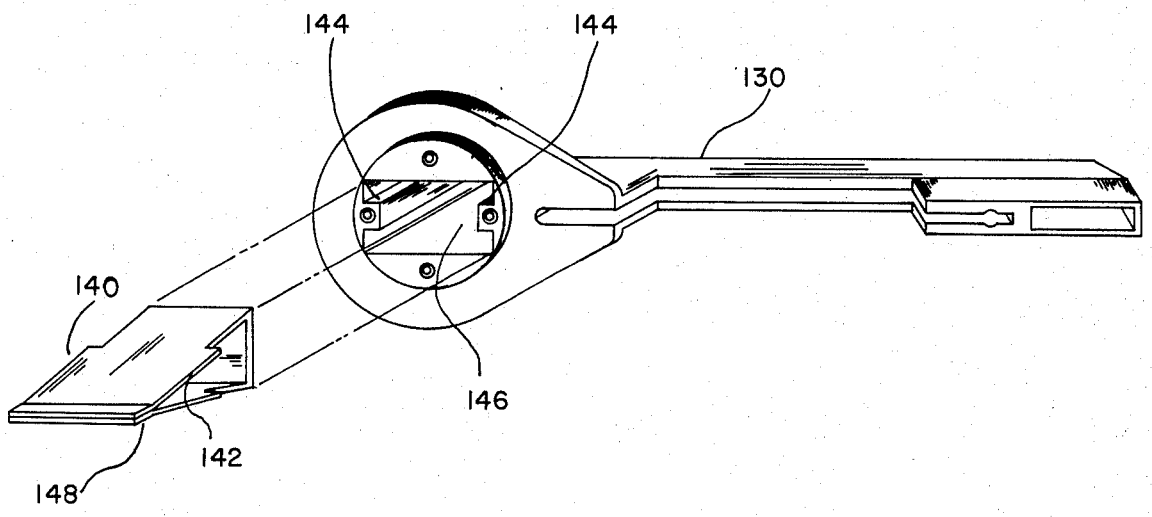
FIG. 3 is an isometric view of a hand lever.

FIG. 3 shows hand lever 130 and spring clip 140. Spring clip 140 is shown in its undisturbed attitude. Spring clip 140 is assembled into hand lever 130 by forcibly spreading it apart so that tabs 142 catch on projections 144 molded into cavity 146 of hand lever 130. Spring clip 140 then grips projections 144 by tabs 142 being urged together by action of the spring material of spring clip 140. Lips 148 of spring clip 140 spread to guide head 114 of drive shaft 108 into cavity 146 as door 106 is closed.

Figure 5:
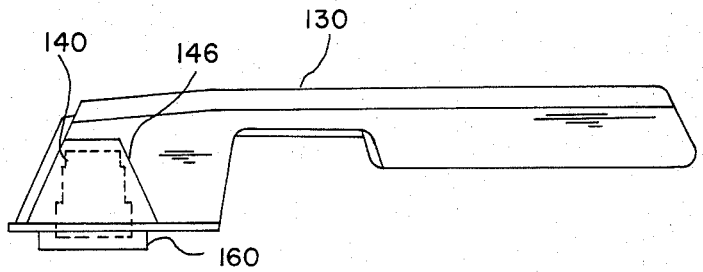
FIG. 5 is a side view of a hand lever.
Figure 6:
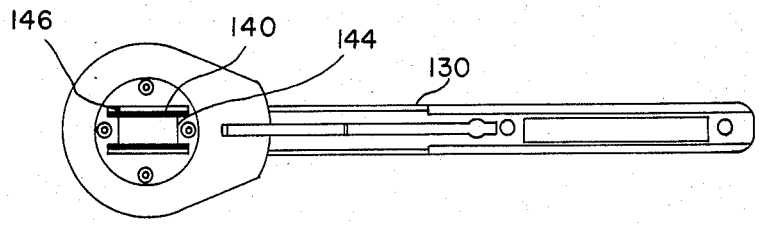
FIG. 6 is a bottom view of a hand lever.
Figure 7:
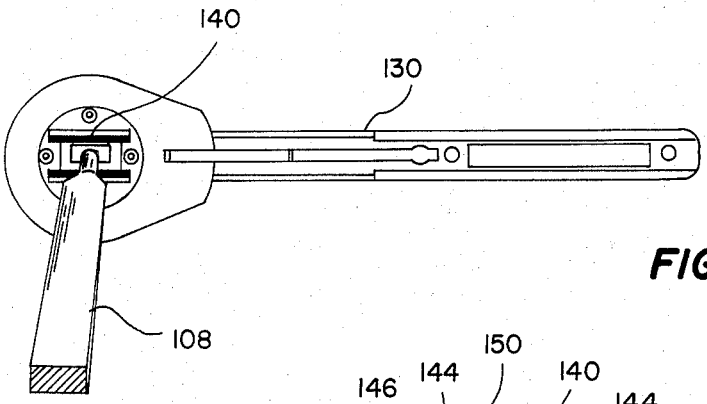
FIG. 7 is a bottom view of a hand lever having a drive shaft inserted in its socket.
Figure 8:
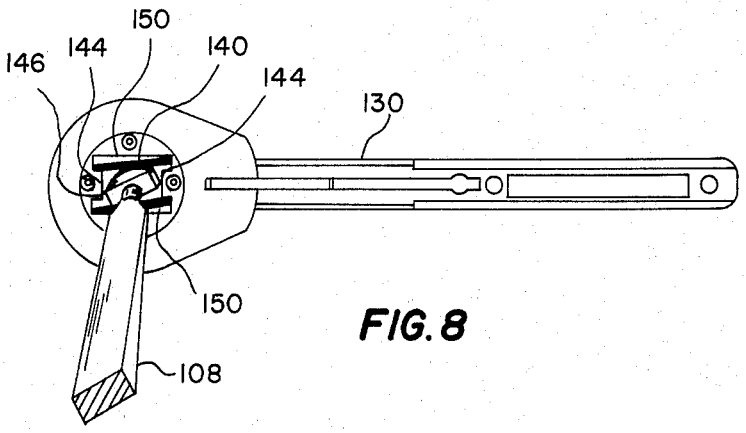
FIG. 8 is a bottom view of a hand lever having a drive shaft inserted in its socket, and having the drive shaft twisted relative to the socket.

FIGS. 4, 5, 6, 7 and 8 show spring clip 140 in hand lever 130. Additionally, FIGS. 7 and 8 show drive shaft 108 inserted into spring clip 140.

Figure 4:
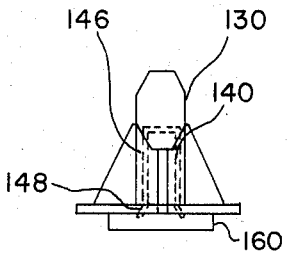
FIG. 4 is an end view of a hand lever.

FIG. 4 is an end view of hand lever 130 and also shows cavity 146 and spring clip 140 as dashed lines. Lips 148 of spring clip 140 are shown spread so as to guide drive shaft 108 into cavity 146 as door 106 is closed.

FIG. 5 is a side view showing spring clip 140 in place in cavity 146 of hand lever 130.

FIG. 6 is a bottom view of hand lever 130 showing spring clip 140 in place in socket 146. Projections 144 are shown holding spring clip 140 in its separated attitude.

FIG. 7 shows drive shaft 108 inserted into spring clip 140. Drive shaft 108 is made slightly thicker than the opening between the sides of clip 140 so that the spring clip lightly grips head 114 of drive shaft 108.

FIG. 8 shows spring clip 140 deformed as a result of torque applied by hand lever 130 to drive shaft 108. With sufficient torque applied, spring clip 140 will come into contact with the interior walls 150 of cavity 146. The dimensions of drive shaft 108 are chosen so that it will be caught by the interior walls 150 of cavity 146 when the torque applied by hand lever 130 is great enough to deform spring clip 140.

Figure 9A:
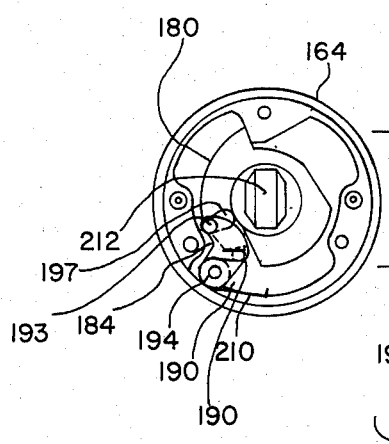
FIG. 9A is a front view of a handle.
Figure 9B:
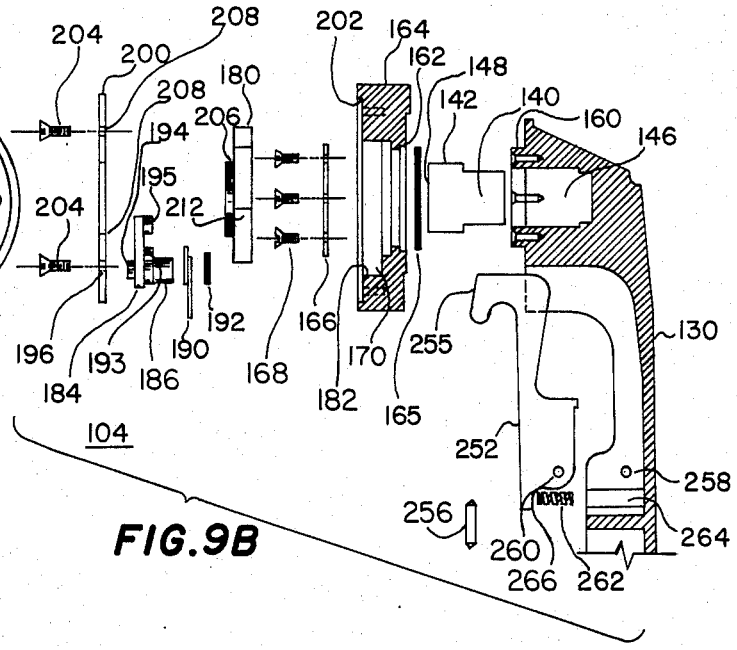
FIG. 9B is an assembly drawing of a handle.
Figure 10:
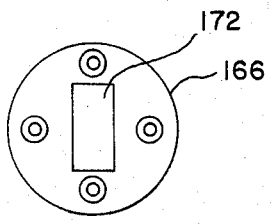
FIG. 10 is a front view of a retainer plate.
Figure 11:
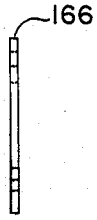
FIG. 11 is an edge view of a retainer plate.

FIG. 9A is a front view of a handle and FIG. 9B is an assembly drawing of handle 104. Hand lever 130 is shown in section. Spring clip 140 fits into cavity 146. Tabs 142 squeeze projections 144 (not shown in FIG. 9). Bearing surface 160 is circular and fits into socket 162 of base 164. "O" ring 165 is made of an elastomeric material and seals the joint between bearing surfaces 160 and 162. Hand lever 130 is held in place on base 164 by retainer plate 166 and screws 168. Screws 168 seat into threaded holes in hand lever 130. Retainer plate 166 rotates on bearing surface 170 when hand lever 130 is rotated relative to base 164. Also, retainer plate 166 holds spring clip 140 in place in socket 146 by catching against lips 148. Opening 172, shown in FIG. 10, in retainer plate 166 is large enough to permit passage of head 114 of drive shaft 108, but small enough to prevent passage of lips 148 of spring clip 140.

It has been found that dimensions of drive shaft head 114 of 0.625 inches by 0.375 inches and dimensions of opening 172 of 0.830 inches by 0.400 inches are satisfactory. These dimensions give a clearance in the long dimension of 0.830 minus 0.625 for a clearance of 0.205 inches; and a clearance in the short dimensions of 0.400 minus 0.375 for a clearance of 0.025 inches. These satisfactory dimensions are nominal and manufacturing variations must be controlled so as to have properly fitting parts.

Interlock 180 mounts in cavity 182 of base 164. The backwall of cavity 182 is formed by bearing surface 170 and retainer plate 166. Defeater 184 also mounts in cavity 182. Cylindrical surface 186 of defeater 184 fits rotatably into hole 188 (not shown in FIG. 9, but shown in FIGS. 13, 18, and 19) of base 164. Spring 190 fits over cylindrical surface 186, and "O" ring 192 also fits over cylindrical surface 186. Projection 194 of defeater 184 fits into hole 196 in base plate 200. Base plate 200 fits into cavity 202 of base 164. Base plate 200 is held in place by screws 204 which screw into threaded holes formed in base 164. Surface 206 of interlock 180 is cylindrical and fits into hole 208 of base plate 200. Hole 208 of base plate 200 is shown more clearly in FIGS. 13 and 17. Interlock 180 rotates relative to base 164 by rotation of surface 206 within hole 208. One end of spring 190 presses against the inside of cavity 182 at point 210. The other end of spring 190 presses against post 193 of defeater 184 and thereby urges rotation of defeater 184. Defeater 184 is shown more clearly in FIGS. 21, 22, and 23. Pawl 195 of defeater 184 engages slot 197 of interlock 180. Interlock 180 is shown more clearly in FIGS. 24, 25, and 26. Pawl 195 urges rotation of interlock 180 into a first position corresponding to the "off" position of hand lever 130. Opening 212 of interlock 180 aligns with opening 172 of retainer plate 166 when handle 130 is in the "off" position.

Figure 12:
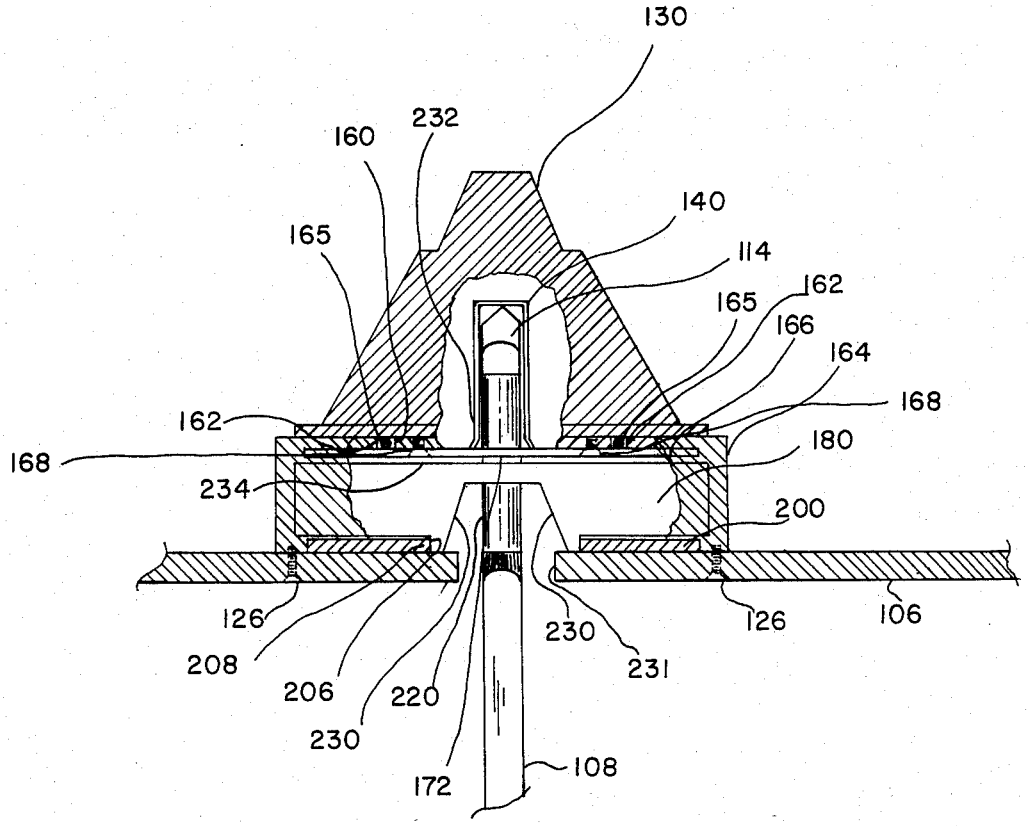
FIG. 12 is a sectional view of a handle.

FIG. 12 is a sectional view of the interior of base 164 and hand lever 130. Spring clip 140 grips head 114 of drive shaft 108. Retainer plate 166 holds hand lever 130 onto base 164. Screws 168 hold retainer plate 166 onto hand lever 130. "O" ring 165 seals the joint between bearing surface 160 and socket 162. Interlock 180 is centered by cooperation between hole 208 in base plate 200 and surface 206 of interlock 180. Interlock 180 rotates about surface 206 turning in hole 208 of base plate 200. Rotation of interlock 180 is caused by operation of defeater 184. Reduced cross-section region 220 of drive shaft 108 passes through interlock 180 and retainer plate 166, and may optionally pass through hole 231 in door 106.

Figure 13:
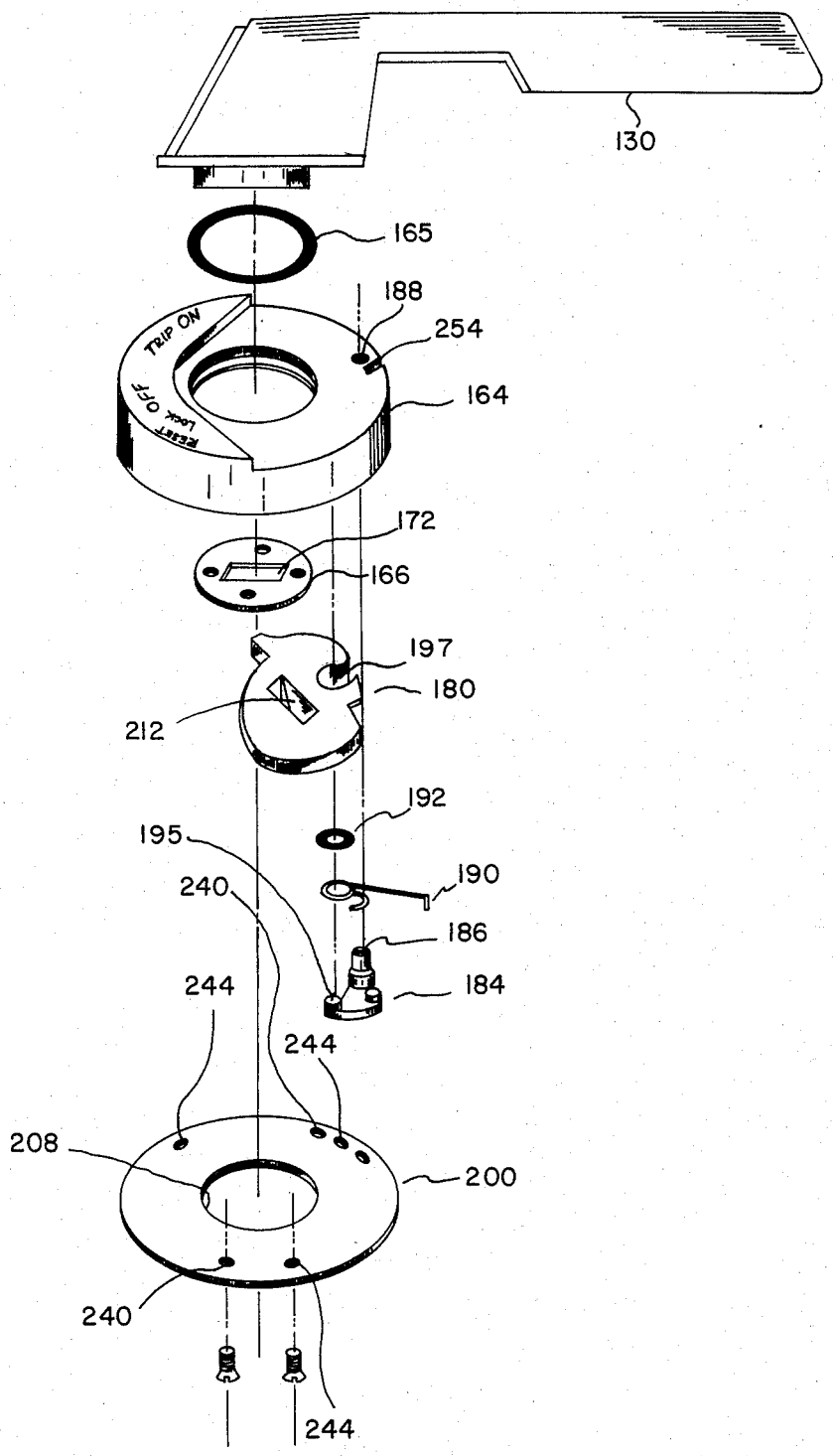
FIG. 13 is an exploded assembly view of a handle.

FIG. 13 is an exploded assembly drawing of handle 104.

Figure 14:
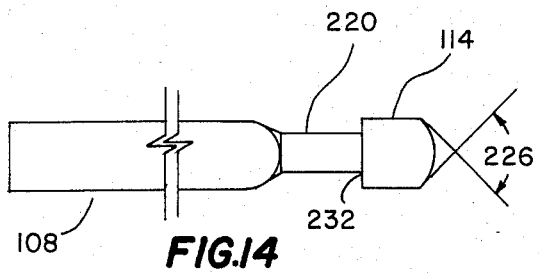
FIG. 14 is a side view of a drive shaft.
Figure 15:
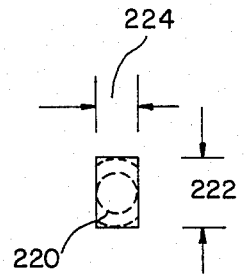
FIG. 15 is an end view of a drive shaft.
Figure 16:
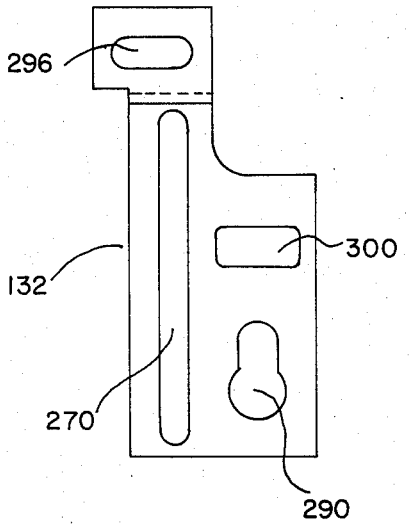
FIG. 16 is a front view of a slider.

FIGS. 14 and 15 are detail drawings of drive shaft 108. FIG. 15 is on end view and shows the cross-sectional shape of drive shaft 108. Dimensions 222 and 224 of drive shaft 108 are chosen in conjunction with dimensions of opening 212 of interlock 180 so that head 114 of drive shaft 108 will fit through opening 212. Satisfactory dimensions for interlock 180 have been found to be 0.40 inches by 0.88 inches for opening 212. Satisfactory dimensions for drive shaft 108 have been found to be dimension 222 at 0.625 inches and dimension 224 at 0.375 inches. Reduced cross-sectional region 220 of drive shaft 180 has been found satisfactory as a circular cross-section having a diameter of 0.375 inches. Angle 226 has been found to be satisfactory at a value of 90 degrees. Clearance in the dimension 222 is 0.88 inches minus 0.625 inches, or 0.255 inches. Clearance in the dimension 224 is 0.40 inches minus 0.375 inches, or 0.025 inches. These satisfactory dimensions are nominal and manufacturing variations must be controlled so as to have properly fitting parts. Also, reduced cross-section region 220 of drive shaft 180 turns inside opening 212 of interlock 180. Slight rotation of opening 212 with respect to drive shaft 108 prevents passage of head 114 through opening 212.

In operation, as door 106 in closed, angle 226 of drive shaft 108 contacts sloped surfaces 230 of interlock 180, as may be seen in FIGS. 1, 12, 14, and 26. Sloped surfaces 230 of interlock 180 guide head 114 of drive shaft 108 through opening 172 of retainer plate 166 and into contact with the interior surfaces of spring clip 140. FIGS. 2 and 12 show the position of head 114 of drive shaft 108 after door 106 is closed. Alignment of the opening 172 in retainer plate 166 with the opening 212 in interlock 180 occurs when hand lever 130 is in the "off" position and spring 190 rotates interlock 180, by means of defeater 184, into the "ordinary" position.

Figure 27:
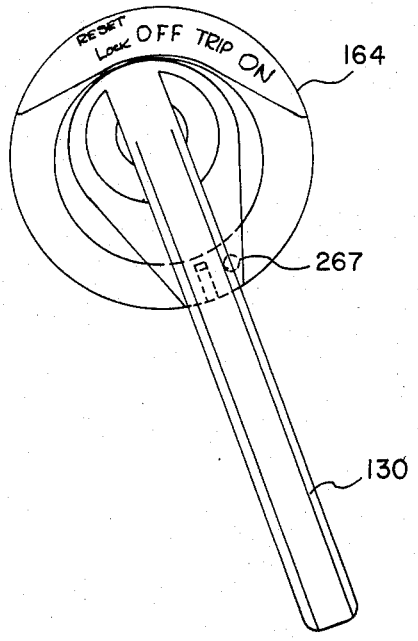
FIG. 27 is a front view of a handle.
Figure 29:
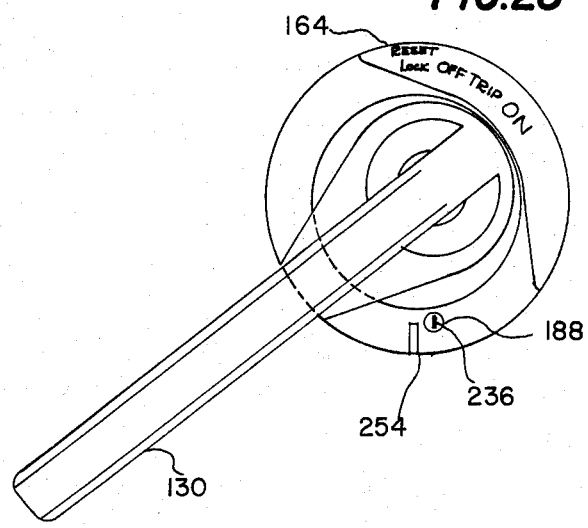
FIG. 29 is a front view of a handle.

After door 106 is closed and head 114 of drive shaft 108 is seated in spring clip 140, as shown in FIG. 12, then hand lever 130 may be rotated into the "on" position. FIG. 27 shows hand lever 130 in the "reset" or "lock" position, in which circuit breaker 100 is in the "off" condition, and FIG. 29 shows hand lever 130 in the "on" position. As hand lever 130 is rotated from the "off" position to the "on" position, drive shaft 108 is rotated by application of torque through spring clip 140 and the inner walls of cavity 146. Rotation of drive shaft 108 moves slide 132 in direction 135, shown in FIG. 2, causing toggle 136 to trip circuit breaker 100 into the "on" condition.

Because of manufacturing and assembly tolerances the circuit breaker 100 may not trip into the "off" condition when hand lever 130 reaches the "off" position. Spring clip 140 and retainer plate 166 cooperate with head 114 of drive shaft 108 to prevent opening of door 106 in situations where circuit breaker 100 does not trip as hand lever 130 passes the "off" position.

The person operating hand lever 130 will continue applying force to hand lever 130 in an effort to cause circuit breaker 100 to trip into the "off" condition. This force causes spring clip 140 to deflect and surface 232 of drive shaft 108, see FIG. 14, catches against retainer plate 166. Retainer plate 166 catching surface 232 of head 114 of drive shaft 108 prevents opening of door 106 when force is applied to hand lever 130. Torque applied to drive shaft 108 by hand lever 130 is transmitted by spring clip 140, and causes deflection of spring clip 140. The prevention of door 106 from being opened when force is applied to hand lever 130 gives rise to the terminology that the operating handle 104 is "torque sensitive". In contrast, the devices of the past discussed above under Background of the Invention are "position sensitive".

With drive shaft 108 rotated so that circuit breaker 100 is in the "on" condition, door 106 cannot be opened because surface 232 of head 114 of drive shaft 108 catches against surface 234 of interlock 180. Thus, interlock 180 in cooperation with head 114 of drive shaft 108 provides the safety feature requiring that door 106 is closed as circuit breaker 100 is turned "on". Also, interlock 180 and head 114 prevent opening of door 106 during the time that circuit breaker 100 is in the "on" condition.

However, a skilled individual may defeat interlock 180 by inserting a screwdriver into slot 236 of defeater 184 and rotating defeater 184 against the tension of spring 190, so that opening 212 of interlock 180 aligns with head 114 of drive shaft 108, when drive shaft 108 is in the position corresponding to circuit breaker 100 being in the "on" condition. By so rotating defeater 184, the skilled individual can open door 106 during the time that circuit beaker 100 is in the "on" condition.

Figure 17:
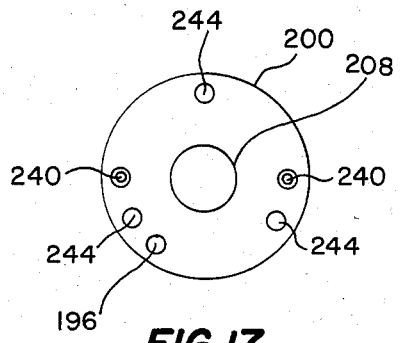
FIG. 17 is a bottom view of a base plate.

FIG. 17 shows base plate 200 in a bottom view. Holes 240 provide attachment of base plate 200 to base 164 by means of screws 204, FIG. 13, screwing into threaded holes 242 in base 164, FIG. 18. Hole 196 provides rotational support for defeater 184 by cooperation with projection 194 of defeater 184, FIGS. 13, 21, and 23. Holes 244 permit passage of screws 126, FIGS. 2 and 12, for mounting base 164 on door 106. Holes 246 in base 164 receive screws 126.

Figure 18:
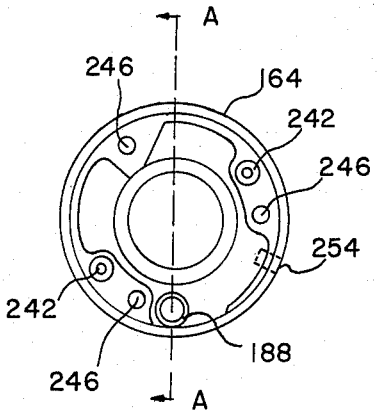
FIG. 18 is a bottom view of a base.
Figure 19:
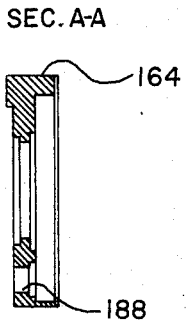
FIG. 19 is a sectional view of a base.

In FIGS. 18 and 19, base 164 is shown, and FIG. 19 is a sectional drawing along section A—A. Hole 188 receives cylindrical surface 186 of defeater 184, thereby permitting access to slot 236, FIGS. 13, 22, and 29, by a skilled individual when door 106 is closed.

Figure 20:
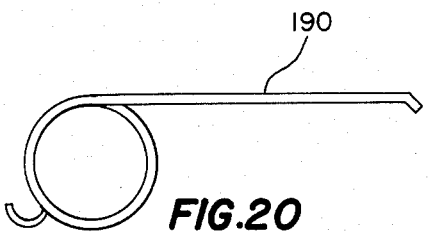
FIG. 20 is a side view of a spring.
Figure 21:
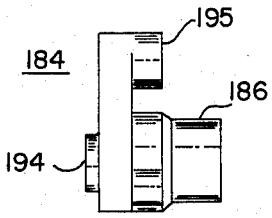
FIG. 21 is a side view of a defeater.
Figure 22:
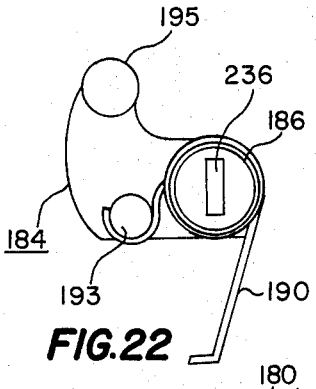
FIG. 22 is a top view of an defeater.
Figure 23:
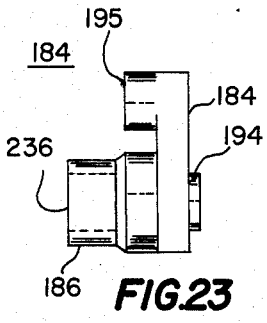
FIG. 23 is a side view of an defeater.
Figure 24:
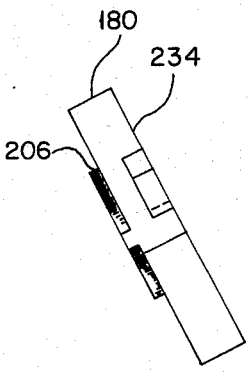
FIG. 24 is an edge view of an interlock.
Figure 25:
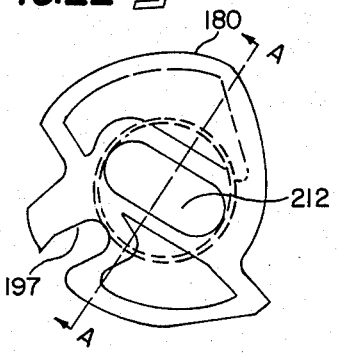
FIG. 25 is a front view of an interlock.
Figure 26:
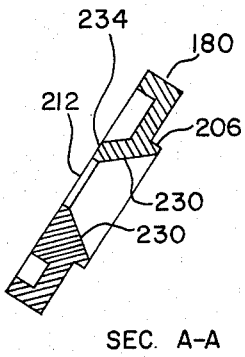
FIG. 26 is a sectional view of an interlock.

FIGS. 20, 21, and 23 show details of spring 190 and defeater 184, and have been discussed above. FIGS. 24, 25, and 26 show details of interlock 180, and have been discussed above.

Figure 28:
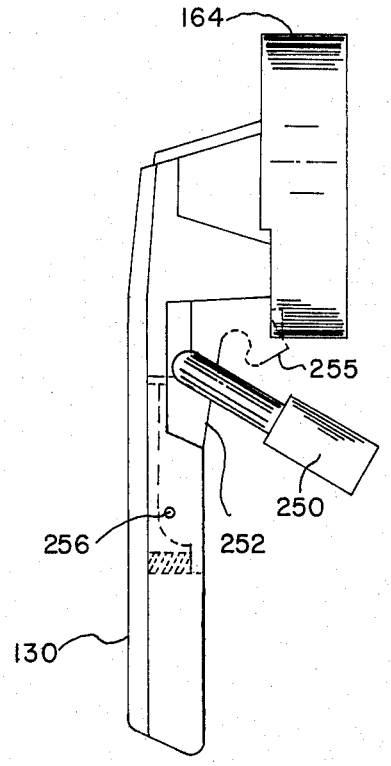
FIG. 28 is a side view of a handle.

FIG. 27 is a front view showing hand lever 130 in the "reset" or "lock" position. FIG. 28 is a side view showing a padlock 250 urging padlock lever 252 into slot 254 made in base 164. Surface 255 of padlock lever 252 fits into slot 254 when hand lever 130 is in the "reset" or "lock" position. The "lock" position is approximately 10 degrees further counterclockwise from the "off" position. Slot 254 is shown in FIGS. 29, 13, and in dashed lines in FIG. 18. Padlock lever 252 pivots about rivet 256 as shown in FIGS. 9 and 28. Rivet 256 is held tightly in hole 258 in hand lever 130. Rivet 256 fits through hole 260 in padlock lever 252 so that padlock lever 252 may rotate freely about rivet 256. Spring 262 fits in hole 164 of hand lever 130 and press against padlock lever 252 at surface 266. The action of spring 262 is to retract surface 255 from slot 254, and also to prevent surface 255 from unintentionally catching in slot 254. Slot 254, and padlock lever 252 provide a means for locking circuit breaker 100 in an "off" condition so as to provide safety for a person working on electrical wiring downstream from circuit breaker 100.

The locked position of hand lever 130 is slightly rotated, about 10 degrees, from the "off" position so that interlock 180 prevents opening of door 106. As a further safety feature, flange 267 of hand lever 130 covers defeater slot 236 when hand lever 130 is locked in the "off" position, thereby preventing opening the door 106 by defeating interlock 180.

FIGS. 16, 30, 31, and 32 give details of slide 132 and bracket 110. Slide 132 is free to move in both directions indicated by double headed arrow 134 by slot 270 sliding on shoulder rivets 272 and 274. Shoulder rivets 272 and 274 are fixedly attached to bracket 110. Lifter 280 is pivotally mounted to bracket 110 by shoulder rivet 282. Drive shaft 108 is attached to lifter 280 by bolt 284. Bolt 284 fits through hole 286 in lifter 280.

Figure 30:
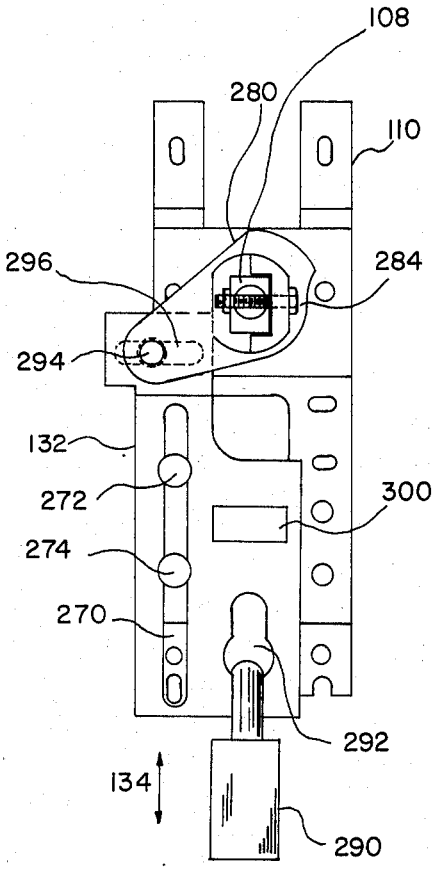
FIG. 30 is a front view of an operator assembly.
Figure 31:
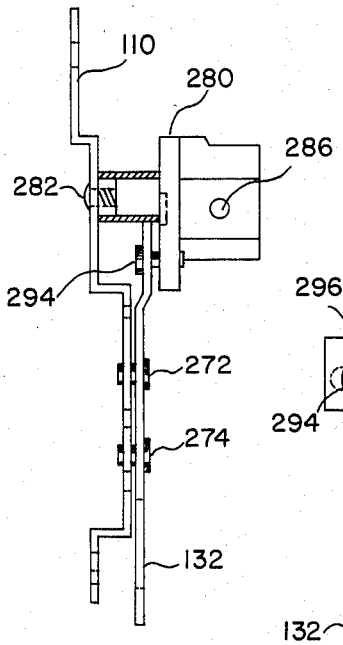
FIG. 31 is a side view of an operator assembly.

FIG. 30 shows slide 132 in the lower, or "off" position. As an additional safety feature, an optional padlock 290 may be inserted through hole 292 in order to lock slide 132 in the "off" position. Padlock 292 provides safety in conditions in which a person desires to have door 106 open and also insure that downstream electrical wiring is not inadvertently activated.

Figure 32:
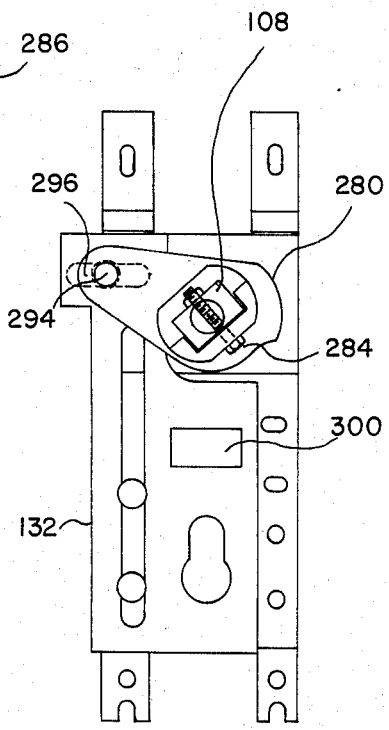
FIG. 32 is a front view of an operator assembly.

Rotation of lifter 280 by rotation of drive shaft 108 causes shoulder rivet 294 to slide in slot 296 so as to raise slide 132 into the "on" position as shown in FIG. 32. Toggle 136 of circuit breaker 100 fits in opening 300 of slide 132, thereby transmitting force to operate toggle 136 as hand lever 130 rotates drive shaft 108.

Hand lever 130 provides a visual indication that circuit breaker 100 has gone into a "trip" condition. Circuit breakers typically are operated by a toggle such as toggle 136. Typically, the toggle of the circuit breaker has an extreme position for "on", an adjacent position for "trip", a further position for "off", and a further extreme position for "reset". Normally the circuit breaker is turned to "on" and electric current is fed to a load by passing through electrical contacts within the circuit breaker. If an excessive electric current begins to flow through the circuit breaker, the circuit breaker goes into a "trip" condition causing the contacts of the circuit breaker to open and the electric current flow to the load to be interrupted, as a safety measure. The toggle moves into the "trip" position under the influence of the internal mechanism of the circuit breaker. The circuit breaker may be reset and turned "on" by moving the toggle first to the "reset" position, an extreme position, and then moving the toggle into the "on" position.

The position of hand lever 130 as shown in FIGS. 27 and 29 may indicate that circuit breaker 100 is in the "trip" condition. The toggle exerts a small force when it goes into the "trip" position. This force is exerted against slider 132 and is sufficient to rotate hand lever 130 into the corresponding angular position, the "trip" position as is shown in FIGS. 27 and 29. A person can then rotate hand lever 130 to the "reset" position and then into the "on" position so as to move toggle 136 first into the "reset" position and then into the "on" position in order to connect electric current to the load after the circuit breaker has tripped off. Also the "lock" position of hand lever 130 is at the "reset" position in order to hold the circuit breaker in the "reset" condition during time periods during which the handle is locked in the "off" condition. Having the "lock" position beyond the "off" position in the counterclockwise sense insures that opening 212 of interlock 180 will be out of alignment with opening 172 in retainer plate 166, thereby insuring that door 106 is locked closed when the handle is locked "off". Also defeater slot 236 is covered and therefore inaccessable when hand lever 130 is locked, as is shown in FIG. 27. A reason for having door 106 interlocked closed when the handle is locked into the "off" position is a safety measure which prevents a person from somehow opening the door and turning the circuit breaker on and thereby endangering a person who is working on apparatus electrically downstream from the circuit breaker.

A further advantage of the invention is the ability of hand lever 130 to be rotated past the "off" position and still apply torque to drive shaft 108. Spring clip 140 deflects under torque as is shown in FIG. 8. Deflection of spring clip 140 under torque allows compensation for manufacturing tolerance in toggle positions in circuit breakers, and also allows compensation for dimensional tolerances in mounting of the parts in the enclosure. Mechanical stops permit rotation of hand lever 130 at least 20 degrees beyond both the "on" position and the "reset" position, and as a consequence toggle 136 may be urged into its "off" position even in the presence of large variations in manufacturing mechanical tolerances.

And a still further advantage of the invention is that deflection of spring clip 140 provides torque on drive shaft 106, and this torque helps to interlock door 106 closed as hand lever 130 is rotated so as to urge toggle 136 into its "off" position. So even though head 114 of drive shaft 108 passes the alignment position of opening 212 in interlock plate 180, the torque applied by spring clip 140 to head 114 prevents opening of door 106 until toggle 136 goes into its "off" position and the torque is released. Further, when torque deforms spring clip 140, head 114 of drive shaft 108 may be caught by retainer plate 166 as a further measure preventing opening of door 106 as hand lever 130 passes the "off" position before toggle 136 goes into its "off" position.

Although the above embodiment of the invention emphasizes the usefulness of the invention for operating a circuit breaker 100, the invention is also useful for operating an electrical switch. An electrical switch may be substituted for circuit breaker 100, and the embodiment of the invention as described above may be advantageously used to operate the switch. Advantages provided by the invention include operation of the switch from outside of a closed enclosure for safety reasons, interlock of the door of the enclosure, and simplicity of design and construction of the invention.

It is to be understood that the above-described embodiments are simply illustrative of the principles of the invention. Various other modifications and changes may be made by those skilled in the art which will embody the principles of the invention and fall within the spirit and scope thereof.

What is claimed is:

1. A circuit breaker operating apparatus having an enclosure, a circuit breaker mounted inside said enclosure, and a hand lever rotatably mounted upon a door of said enclosure comprising:

a drive shaft rotatably attached at a first end to said circuit breaker so that rotation of said drive shaft operates said circuit breaker, and when said door is closed a second end of said drive shaft seats in a socket formed within said hand lever;

a spring clip mounted within said socket formed within said hand lever, and said spring clip grips said second end of said drive shaft so that force applied by said hand lever to rotate said drive shaft may deform said spring clip thereby permitting deflection in a coupling between said hand lever and said drive shaft; and, a retainer plate firmly attached to and rotatable with said hand lever, and having an opening through which said drive shaft passes when said second end of said drive shaft seats in said socket, and said second end of said drive shaft catches against said retainer plate when said spring clip is deformed by said force applied to said hand lever, thereby preventing opening of said door as a safety measure.

2. An apparatus as in claim 1 further comprising:

means for catching said drive shaft by said handle when said spring clip is deformed by said force and thereby preventing opening of said door as a safety measure.

3. The apparatus as in claim 2 wherein said means for catching said drive shaft by said handle comprises:

a retainer plate having a substantially rectangular opening therein and attached to and rotatable with said hand lever; and, said drive shaft having a reduced cross section region located within said substantially rectangular opening of said retainer plate when said door is closed, and said second end of said drive shaft having a substantially rectangular cross section region for seating in said socket in said hand lever when said door is closed, so that said substantially rectangular cross section region of said drive shaft catches against said retainer plate when said spring clip is deformed by force applied to said hand lever.

4. An apparatus as in claim 1 wherein said retainer plate has a rectangular opening and said second end of said drive shaft has a rectangular cross-section having a size to fit through said opening when said opening is aligned with said drive shaft, and a size to catch said second end of said drive shaft when said opening and said drive shaft are not aligned.

5. An apparatus as in claim 4 wherein a clearance between said drive shaft and said opening in said retainer plate is nominally 0.025 inches.

6. An apparatus as in claim 1 wherein said drive shaft has a reduced cross-section region between said first end and said second end;

an interlock mounted in a fixed position with respect to said door of said enclosure, and when said door is closed said reduced cross-section region of said drive shaft is located within an opening of said interlock permitting rotation of said drive shaft, and said interlock prevents opening of said door when said drive shaft is in a position corresponding to an "on" condition of said circuit breaker by catching said second end of said drive shaft, so that when said door is closed and said circuit breaker is in an "on" condition, then said interlock prevents opening of said door.

7. An apparatus as in claim 6 wherein a clearance between said drive shaft and said opening in said interlock is nominally 0.025 inches.

8. A circuit breaker operating apparatus having an enclosure, a circuit breaker mounted inside said enclosure, and a hand lever rotatably mounted upon a door of said enclosure comprising:

a drive shaft rotatably attached at a first end to said circuit breaker so that rotation of said drive shaft operates said circuit breaker, and when said door is closed a second end of said drive shaft seats in a socket in said hand lever, and rotation of said hand lever rotates said drive shaft, said drive shaft having a reduced cross-section region between said first end and said second end;

an interlock mounted in a fixed position with respect to said door of said enclosure, and said interlock having a shaped opening for receiving said drive shaft as said door is closed, and said second end of said drive shaft having a shaped cross-section having a size to fit through said shaped opening when said shaped opening is aligned with said drive shaft, and when said door is closed said reduced cross-section region of said drive shaft is located within said shaped opening of said interlock permitting rotation of said drive shaft, and said interlock prevents opening of said door when said drive shaft is in a position corresponding to an "on" condition of said circuit breaker by catching said second end of said drive shaft, so that when said door is closed and said circuit breaker is in an "on" condition, then said interlock prevents opening of said door.

9. An apparatus as in claim 8 wherein said interlock has a rectangular opening and said second end of said drive shaft has a rectangular cross-section having a size to fit through said opening when said opening is aligned with said drive shaft.

10. An apparatus as in claim 9 wherein a clearance between said drive shaft and said opening in said interlock is nominally 0.025 inches.

11. An apparatus as in claim 8 further comprising a spring clip mounted within said socket in said hand lever, and said spring clip grips said second end of said drive shaft so that force applied by said hand lever to rotate said drive shaft may deform said spring clip thereby permitting deflection in a coupling between said hand lever and said drive shaft.

12. A circuit breaker operating apparatus having an enclosure, a circuit breaker mounted inside said enclosure, and a hand lever rotatably mounted upon a door of said enclosure comprising:

a drive shaft rotatably attached at a first end to said circuit breaker so that rotation of said drive shaft operates said circuit breaker, and when said door is closed a second end of said drive shaft enters a socket in said hand lever, and rotation of said hand lever rotates said drive shaft, said drive shaft having a reduced cross-section region between said first end and said second end;

a spring clip mounted within said socket in said hand lever, and said spring clip grips said second end of said drive shaft so that force applied by said hand lever to rotate said drive shaft may deform said spring clip thereby permitting deflection in a coupling between said hand lever and said drive shaft so that deformation of said spring clip permits said second end of said drive shaft to catch within said handle thereby preventing opening of said door when said force is applied to said hand lever;

an interlock mounted in a fixed position with respect to said door of said enclosure, and when said door is closed said reduced cross-section region of said drive shaft is located within an opening of said interlock permitting rotation of said drive shaft, and said interlock preprevents opening of said door when said drive shaft is in a position corresponding to an "on" condition of said circuit breaker by catching said second end of said drive shaft, so that when said door is closed, and said circuit breaker is in an "on" condition, and no force is applied to said hand lever, then said interlock prevents opening of said door.

* * * * *